US006045058A

United States Patent [19]

Döbbeling et al.

[11] Patent Number: 6,045,058

[45] Date of Patent: Apr. 4, 2000

[54] PRESSURE ATOMIZER NOZZLE

[75] Inventors: Klaus Döbbeling, Windisch; Christian Steinbach, Neuenhof, both of Switzerland; Martin Valk, München, Germany

[73] Assignee: ABB Research Ltd., Zurich, Switzerland

[21] Appl. No.: 09/114,883

[22] Filed: Jul. 14, 1998

[30] Foreign Application Priority Data

Jul. 17, 1997 [DE] Germany ..... 197 30 617

[51] Int. Cl.[7] ..... B05B 17/04; B05B 7/10

[52] U.S. Cl. ..... 239/11; 239/404; 239/405; 239/600

[58] Field of Search ..... 239/1, 11, 398, 239/399, 403, 404, 405, 406, 590, 590.3, 600

[56] References Cited

U.S. PATENT DOCUMENTS

| | | | |
|---|---|---|---|
| 5,269,495 | 12/1993 | Döbbeling | 239/590.3 |
| 5,335,608 | 8/1994 | Dehn et al. | 239/405 X |
| 5,845,716 | 12/1998 | Birk | 239/405 X |
| 5,934,555 | 8/1999 | Döbbeling et al. | 239/11 |

FOREIGN PATENT DOCUMENTS

| | | |
|---|---|---|
| 0321809B1 | 6/1989 | European Pat. Off. . |
| 0496016B1 | 7/1992 | European Pat. Off. . |
| 1 808 722 | 6/1970 | Germany . |
| 2 417 130 | 11/1974 | Germany . |
| 31 32 352 | 8/1982 | Germany . |
| 38 11 261 | 10/1989 | Germany . |
| 41 18 538 | 12/1992 | Germany . |
| 41 37 136 | 5/1993 | Germany . |
| 43 26 802 | 2/1995 | Germany . |
| 19510744A1 | 9/1996 | Germany . |
| 90/07088 | 6/1990 | WIPO . |
| 93/13359 | 7/1993 | WIPO . |

OTHER PUBLICATIONS

Miller, R.V., "Lexikon Der Energietechnik Und Kraftmaschinen", p599–600, 1965.

*Primary Examiner*—Andres Kashnikow
*Assistant Examiner*—Sean P. O'Hanlon
*Attorney, Agent, or Firm*—Burns, Doane, Swecker & Mathis, L.L.P.

[57] ABSTRACT

The invention relates to a two-stage pressure atomizer nozzle with a nozzle body (30) having a mixing chamber (39) which is connected to an outside space via a nozzle outlet bore (33), and with a first feed duct (42) with a feed bore (41) for a liquid (37) to be atomized, through which feed bore said liquid (37) can be fed, free of swirling and under pressure, at least one further feed duct (36) for a portion of the liquid (37) to be atomized or for a second liquid (37') to be atomized opening into the chamber (39), through which feed duct said liquid (37, 37') can be fed under pressure and with swirling. The feed bore (41) of the first feed duct (42) lies on one axis (34) with the nozzle outlet bore (33). It is defined in that the outlet-side diameter ($d_a$) of the nozzle outlet bore (33) is at most as large as the diameter ($d_z$) of the feed bore (41) and the length (L) of the nozzle outlet bore (33) is at least twice to at most ten times the outlet-side diameter ($d_a$) of the nozzle outlet bore (33).

10 Claims, 3 Drawing Sheets

II – II

III – III

PRESSURE ATOMIZER NOZZLE

BACKGROUND OF THE INVENTION

1. Field of the Invention

The invention relates to the field of combustion technology. It refers to a pressure atomizer nozzle, comprising a nozzle body with a mixing chamber which is connected to an outside space via a nozzle bore. The nozzle body has a first feed duct for a liquid to be atomized, through which duct said liquid can be fed under pressure, free of swirling, to this chamber. At least one further feed duct for a portion of the liquid to be atomized or for a second liquid to be atomized opens into the chamber of the nozzled body, through which duct said portion of liquid or the second liquid can be fed under pressure and with swirling. A nozzle of this type is known, for example, from DE 196 08 349.4.

2. Discussion of Background

Atomizer burners, in which the oil undergoing combustion is finely distributed mechanically, are known. The oil is decomposed into fine droplets of a diameter of about 10 to 400 $\mu$m (oil mist) which, whilst mixing with the combustion air, are evaporating in the flame and are burnt. In pressure atomizers (see Lueger-Lexikon der Technik [Lueger Lexicon of Technology], Deutsche Verlags-Anstalt Stuttgart, 1965, Volume 7, page 600), the oil is fed under high pressure to an atomizer nozzle by means of an oil pump. The oil passes via essentially tangentially extending slits into a swirl chamber and leaves the nozzle via a nozzle bore. This ensures that the oil particles acquire two movement components, an axial and a radial. Due to centrifugal force, the oil film emerging as a rotating hollow cylinder from the nozzle bore widens to form a hollow cone, the edges of which begin to vibrate in an unstable manner and break up into small oil droplets. The atomized oil forms a cone having a greater or lesser aperture angle.

However, in the low-pollutant combustion of mineral fuels in modern burners, for example in premixing burners of the double cone type, the basic design of which is described in EP 0 321 809 B1, special requirements are placed on the atomization of the liquid fuel. These are primarily as follows:

1. The droplet size must be small, so that the oil droplets can evaporate completely prior to combustion.

2. The aperture angle (angle of spread) of the oil mist should be small, particularly in the case of combustion under increased pressure.

3. The drops must have high velocity and high momentum, so as to be capable of penetrating sufficiently far into the compressed mass stream of combustion air, so that the fuel vapor can be premixed completely with the combustion air before it reaches the flame front.

Swirl nozzles (pressure atomizers) and air-assisted atomizers of known types, with a pressure of up to about 100 bar, are scarcely suitable for this purpose, since they do not allow a small angle of spread, the atomization quality is restricted and the momentum of the drop spray is low.

In the case of swirl-stabilized burners (for example burners of the double cone type), in which flame stabilization is achieved with the aid of a swirl flow, the region between the swirl generator and the recirculation zone, which occurs due to the swirl flow bursting open, is suitable for mixing in and evaporating the liquid fuel. To achieve good preevaporation, the fuel should be introduced, finely atomized, into the flow, which can be carried out in the simplest way by means of a pressure atomizer nozzle. If the fine droplets are exposed to a swirl flow field, however, this may cause the drops to be thrown out because of the centrifugal forces (cyclone effect). The result of wetting the swirl generator or the mixing tube walls would be that mixing would be impaired and there would be the risk of flashback along the walls and deposits occurring due to fuel decomposition.

As a consequence of this insufficient evaporation and premixing of the fuel, therefore, it is necessary for water to be added in order to lower the flame temperature and consequently prevent NOx formation locally. Since the water supplied also often disturbs flame zones which, although per se generating only a small amount of NOx, are very important for flame stability, instabilities, such as flame pulsation and/or poor burnout, frequently occur, thus leading to an increase in CO emission.

An improvement can be achieved by means of the high pressure atomization nozzle known from EP 0 496 016 B1. This consists of a nozzle body, in which a turbulence chamber is designed, said turbulence chamber being connected to an outside space via at least one nozzle bore and having at least one feed duct for the liquid to be atomized which is capable of being fed under pressure. Said nozzle is defined in that the cross-sectional area of the feed duct opening into the turbulence chamber is larger by the factor 2 to 10 than the cross-sectional area of the nozzle bore. This arrangement makes it possible, in the turbulence chamber, to generate a high turbulence level which does not die out on the way to the outlet of the nozzle. The liquid jet is rapidly decomposed by the turbulence generated in front of the nozzle bore in the outside space, that is to say after leaving the nozzle bore, low angles of spread of 20 ° and less being obtained. The droplet size is likewise very small.

When gas turbine burners are being operated with liquid fuel, the aim is to generate a drop spray, if possible over the entire load range of the gas turbine (approximately 10% to 120% fuel mass flow in relation to rated load conditions), said spray making it possible in the entire range to achieve low-pollutant and stable combustion in a predetermined air flow field.

The use of an above described high pressure atomizer nozzle for the atomization of liquid fuel in gas turbine burners certainly leads, as desired, under full load and overload (100–120%) to a pressure (100 bar) which is not too high and to a small droplet size, undesirable wall wetting and coking being avoided on account of the narrow spray angle.

Under part load, however, the fuel admission pressure drops because of the falling overall fuel mass flow. Yet the energy for pressure atomizers, which is necessary for atomization, is determined by the fuel admission pressure, so that, in this load range, the atomization quality is impaired and the depth of penetration of the fuel spray into the air flow decreases due to the low fuel admission pressure.

This disadvantage is overcome by means of the two-stage pressure atomizer nozzle according to DE 196 08 349.4 which has already been mentioned. This is operated via a swirlfree main turbulence generating stage in the full load and overload mode and additionally or else solely via a pressure swirl stage in the part load and low load mode. The disadvantage of this solution, however, is that, because of the high turbulence in the jet of the main turbulence generating stage, it is not possible to have very narrow spray angles (<15°). For specific instances of use, in which the burner air is sharply swirled, however, very narrow fuel jet angles are necessary in order to avoid the walls being coated. In principle, jet nozzles, so-called plain jets, are suitable for this purpose. These, however, produce atomization which is somewhat unsuitable for igniting the burner.

SUMMARY OF THE INVENTION

The invention attempts to avoid all these disadvantages. The object on which it is based is to develop a pressure atomizer nozzle of the abovementioned type, which has a simple design and makes it possible for a liquid or liquids to be atomized to have a spray angle or degree of atomization exactly adapted to the respective operating conditions. In this case, above all, extremely small spray angles are also to be implemented, atomization being suppressed and only delayed disintegration of the liquid stream occurring. Moreover, a method for the effective operation of this pressure atomizer nozzle is proposed.

This is achieved, according to the invention, in a pressure atomizer nozzle, comprising a nozzle body, in which a mixing chamber is designed, said mixing chamber being connected to an outside space via a nozzle outlet bore and having a first feed duct with a feed bore for a liquid to be atomized, through which feed bore said liquid can be fed, free of swirling and under pressure, at least one further feed duct for a portion of the liquid to be atomized or for a second liquid to be atomized opening into the chamber, through which feed duct said portion of liquid or the second liquid can be fed under pressure and with swirling, the feed bore of the first feed duct lying on one axis with the nozzle outlet bore, in that the outlet-side diameter of the nozzle outlet bore is at most as large as the diameter of the feed bore and the length of the nozzle outlet bore is at least twice to at most ten times the outlet-side diameter of the nozzle outlet bore.

The advantages of the invention are, inter alia, that there is the possibility of reducing the spray angle of the nozzle to an extremely small angle, that is to say so as to form a full jet without disturbing turbulences. This takes account of the particular features of the swirl flow field of a swirl-stabilized burner. On the other hand, the mode of operation of a conventional fine-atomizing pressure atomizer nozzle can be preserved. Sliding regulation makes it possible to set all operating states, that is to say spray angles and degrees of atomization, between these extremes. Adhering to the abovementioned ratio of length to diameter of the nozzle outlet bore ensures that, on the one hand, the swirl from the swirl stage is not reduced too greatly and, consequently, atomization in the pressure atomizer mode is sufficient and, on the other hand, the divergence of the full jet is sufficiently low to ensure that drops cannot be thrown out undesirably.

It is particularly expedient if the pressure atomizer nozzle has an outlet-side diameter of the nozzle outlet bore which is smaller than the diameter of the feed bore, and, in particular, it is to amount to about 0.7 times the diameter of the feed bore. This ensures that a larger proportion of the overall pressure drop takes place via the outlet orifice, thus resulting in the full jet having high stability.

Furthermore, a design variant is advantageous, in which the nozzle outlet bore is arranged in the cover of a first tube, in which a second tube of smaller outside diameter is inserted, said second tube reaching as far as said cover, and in the cover-side end of the second tube at least one slit is provided, which is set tangentially and forms a swirl duct and which connects the annular space between the first and second tubes to the chamber, from which the nozzle outlet bore leads into the outside space, the chamber being delimited essentially by the cover, the inner walls of the second tube and a filling piece in the second tube, and the feed bore in the filling piece being arranged on the same axis as the nozzle outlet bore. This nozzle is distinguished by a simple design.

Finally, a pressure atomizer nozzle according to the invention, the nozzle outlet bore of which has a constant cross-sectional area over it entire length, is advantageously used. This can be produced very simply.

If, by contrast, a two-stage pressure atomizer nozzle according to the invention is used, the nozzle outlet bore of which has, over its entire length, a cross-sectional area decreasing continuously in the direction of flow, uniform acceleration of the liquid to be atomized is advantageously achieved in the swirl stage as a result of the converging part. The frictional losses are lower than in a design variant in which a nozzle with a constant cross section of the nozzle outlet bore is provided. By means of this geometry, atomization is suppressed when the nozzle is operating in the full jet stage, and delayed disintegration of the liquid stream occurs.

It is advantageous, furthermore, if the pressure atomizer nozzle according to the invention has a nozzle outlet bore possessing, at its inflow-side end, an inflow radius which is at least as large as the radius of the mixing chamber. This prevents the flow from breaking away on entry into the outlet bore, and flow losses or cavitation, which is possible at high velocities, are thereby prevented.

BRIEF DESCRIPTION OF THE DRAWING

A more complete appreciation of the invention and many of the attendant advantages thereof will be readily attained as the same becomes better understood by reference to the following detailed description, when considered in connection with the accompanying drawing wherein.

Only the elements essential for understanding the invention are shown. For example, regulating members, by means of which the size of the liquid stream flowing through the individual stages of the nozzle can be influenced, are not illustrated. The direction of flow of the media is designated by arrows.

DESCRIPTION OF PREFERRED EMBODIMENTS

Figure 2:
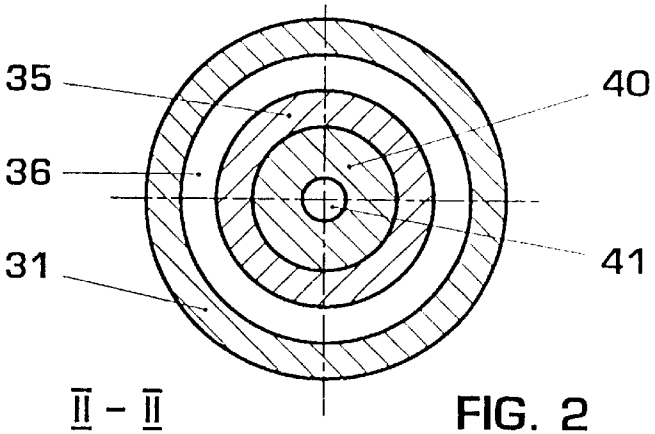
FIG. 2 shows a cross section through the pressure atomizer nozzle according to FIG. 1 in the region of the full jet stage along the line II—II.
Figure 3:
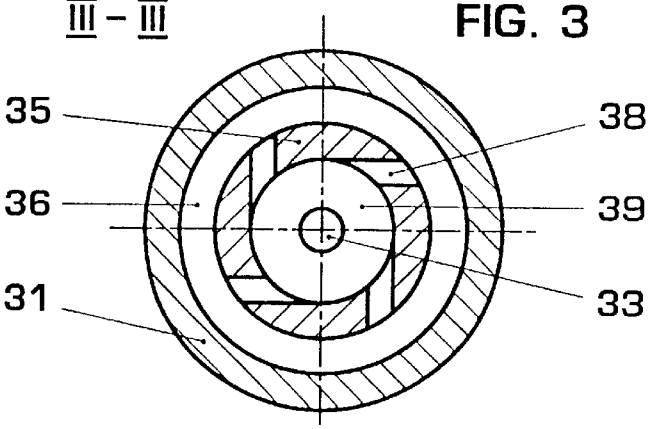
FIG. 3 shows a cross section through the pressure atomizer nozzle according to FIG. 1 in the region of the swirl stage along the line III—III.
Figure 1:
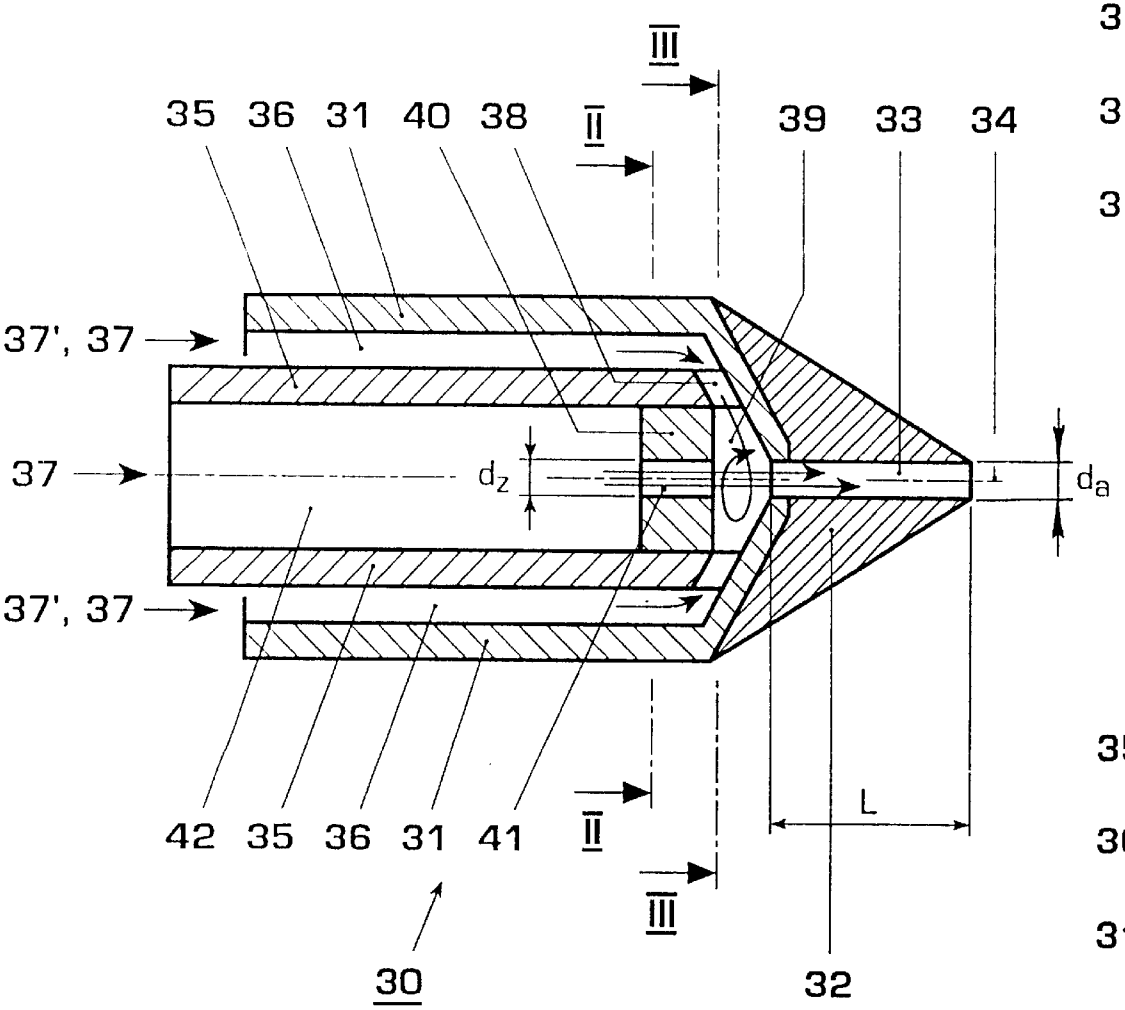
FIG. 1 shows a part longitudinal section through a pressure atomizer nozzle according to the invention with a full jet stage and swirl stage in a first design variant.

Referring now to the drawings, wherein like reference numerals designate identical or corresponding parts through the several views, FIGS. 1 to 3 show a first exemplary embodiment of the invention, FIG. 1 illustrating the pressure atomizer nozzle in a part longitudinal section and FIGS. 2 and 3 showing two cross sections in different planes.

The pressure atomizer nozzle comprises a nozzle body 30, consisting of a first tube 31 which, at its end seen in the direction of flow, is closed by means of a conical cover 32. Arranged in the middle of the cover 32 is a nozzle bore 33, the longitudinal axis of which is designated by 34. According to the invention, the length of the nozzle outlet bore amounts to at least twice to at most ten times the outlet-side diameter of the nozzle outlet bore. Inserted into the tube 31 is a second tube 35 which has a smaller outside diameter than the inside diameter of the first tube 31 and which reaches as far as the cover 32 and rests on the latter. The annular space 36 between the two tubes 31 and 35 serves for feeding the liquid 37 to be atomized or a portion of said liquid or a second liquid 37'. That end of the tube 35 which rests on the cover 32 is provided with four tangentially set slits 38 which connect the annular space 36 to a chamber 39 serving as a swirl chamber for the liquid 37 or the second liquid 37' to be atomized which flows in through the slits 38. The chamber 39 is delimited by the inner walls of the cover 32 and of the second tube 35 and by a filling piece 40 which is pushed in inside the second tube 35 and is fastened therein. This filling piece 40 is level with the top edge of the slits 38, but, in another design variant not illustrated, it may also be spaced from the top edge of the slits 38. A feed bore 41 for the liquid 37 to be atomized or for the second liquid 37' to be atomized is arranged in the filling piece 40, said feed bore allowing a swirlfree flow of the liquid from the feed duct 42 into the chamber 39. The feed bore 41 lies on the same axis 34 as the nozzle outlet bore 33. In this first exemplary embodiment, the feed bore 41 has a constant diameter $d_z$ over its entire length L. This diameter $d_z$ is dimensioned somewhat larger, as compared with the diameter $d_a$ of the nozzle outlet bore 33. The ratio of $d_a$ to $d_z$ should preferably be about 0.7. Then, when the nozzle is operated in the full jet stage, good stability of the full jet is achieved, because a greater proportion of the overall pressure drop occurs via the nozzle outlet bore. The ratio of the length L to the outlet-side diameter $d_a$ of the nozzle outlet bore 33 is also particularly important for the functioning of the nozzle. According to the invention, said ratio is in a range of 2 to 10. In particular, if the length to diameter ratio is too high, the swirl from the swirl stage is reduced too greatly and atomization in the pressure atomizer mode is insufficient. By contrast, if the ratio of length to diameter of the nozzle outlet bore 33 is too low, the full jet has excessive divergence, and this may cause drops to be thrown out undesirably.

The pressure atomizer nozzle according to the invention thus has two modes of operation, namely a full load and overload modes in which the nozzle is operated via a full jet stage (see FIG. 2) and a part load mode in which the nozzle is operated via a pressure swirl stage (see FIG. 3), which may be operated either jointly or else individually, as required.

In contrast to the exemplary embodiment illustrated, the pressure atomizer nozzle may also be provided with more or fewer slits 38. A different distribution of the ducts over the circumference is likewise also possible. Instead of the slits 38, other swirl generators, for example blades, may also be arranged in the duct 36, these ensuring that the liquid to be atomized enters the chamber 39, swirled, from the duct 36.

Figure 4:
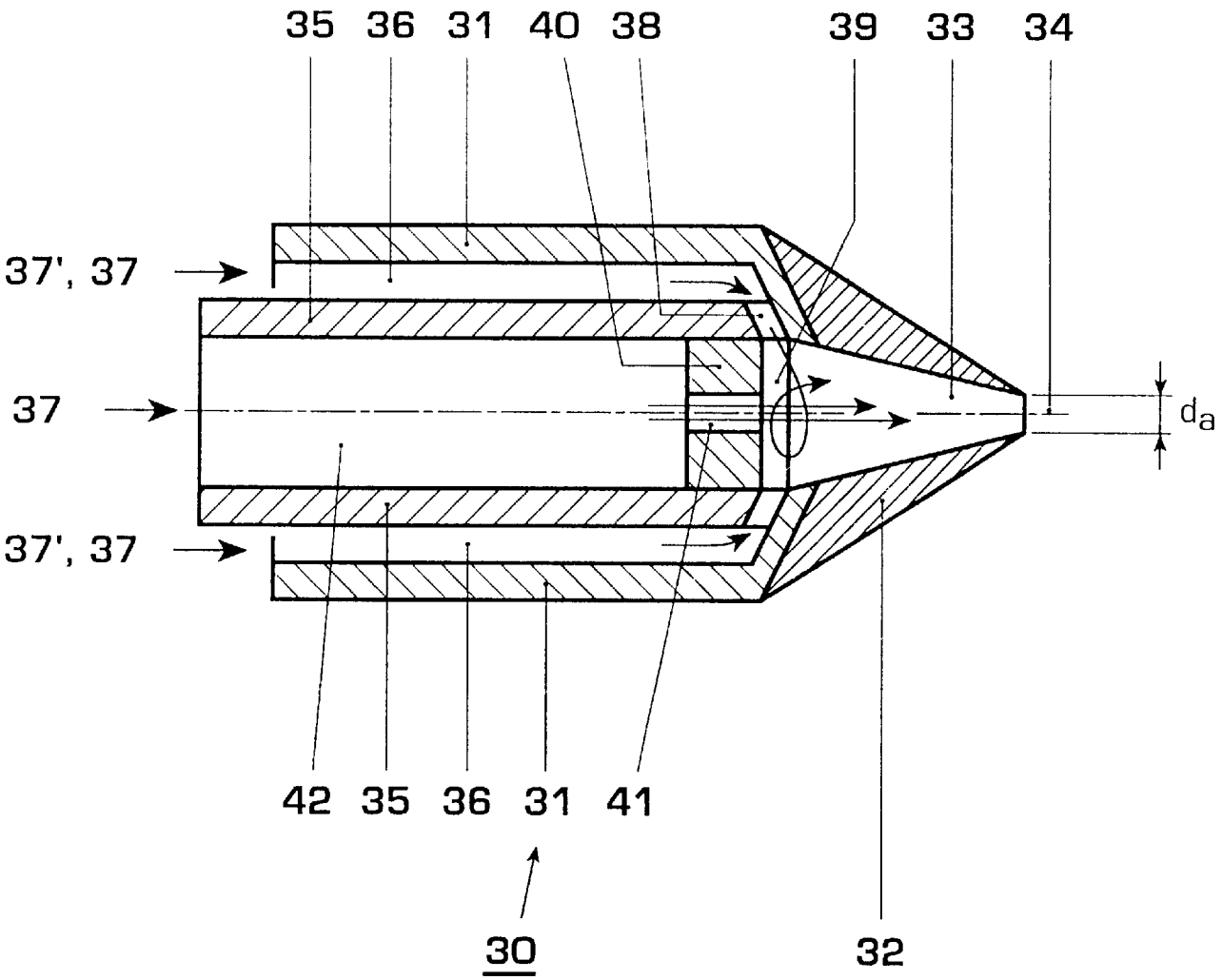
FIG. 4 shows a part longitudinal section through a pressure atomizer nozzle according to the invention with a full jet stage and swirl stage in a second design variant.

FIG. 4 shows a part longitudinal section through a second exemplary embodiment of a two-stage pressure atomizer nozzle according to the invention with a full jet stage and a swirl stage. The design of the nozzle differs from the above described exemplary embodiment only in that the nozzle outlet bore 33 does not have a constant diameter, but the diameter decreases continuously, as seen in the direction of flow, over the entire length L of the nozzle outlet bore as far as the actual outlet. This has the additional advantages, as compared with the first exemplary embodiment, that uniform acceleration of the liquid stream takes place in the nozzle, that the frictional losses in the swirl stage are reduced, that no turbulences occur in the full jet stage or any that are present are reduced, and that atomization of the liquid is suppressed.

Figure 5:
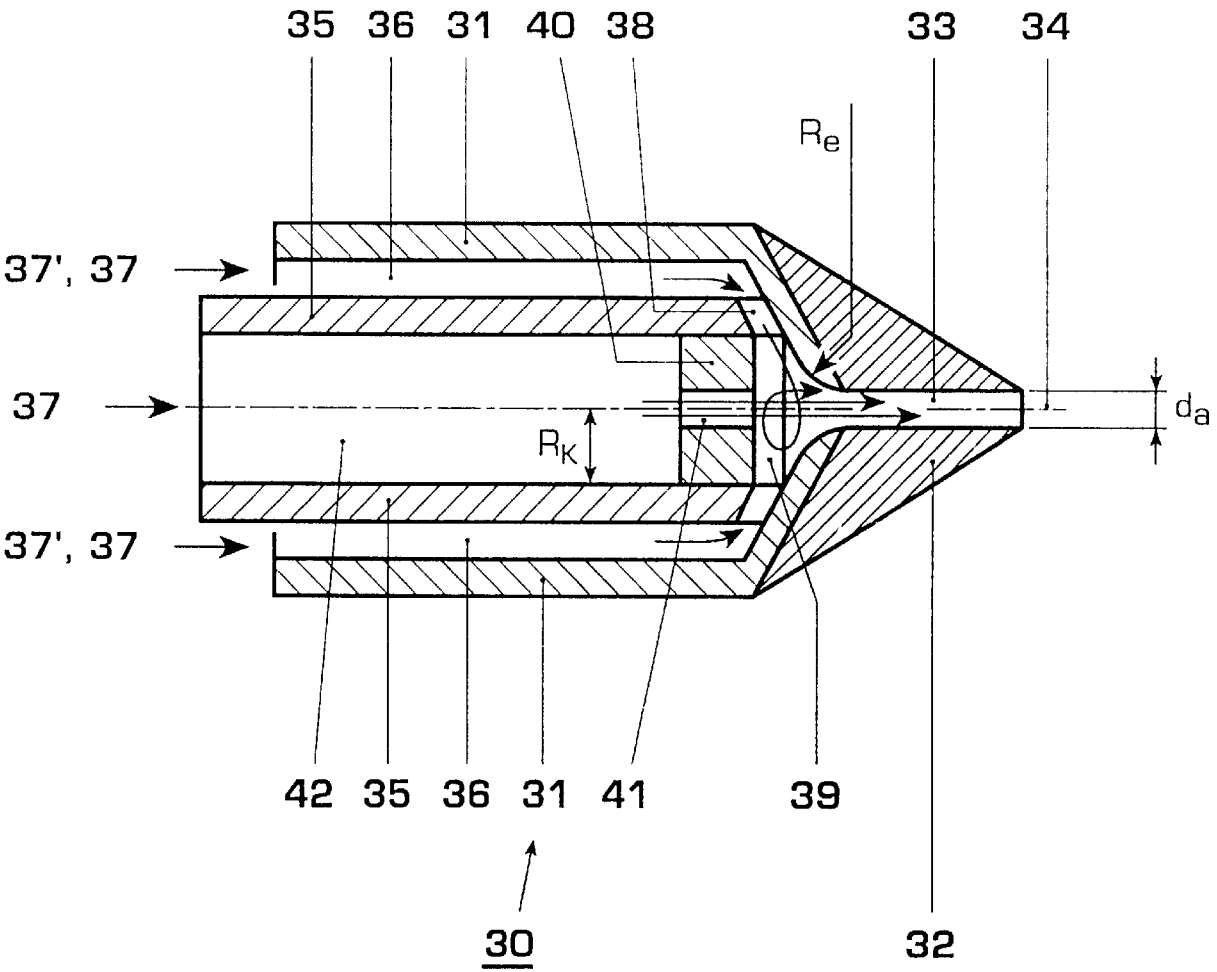
FIG. 5 shows a part longitudinal section through a pressure atomizer nozzle according to the invention with a full jet stage and swirl stage in a third design variant.

FIG. 5 shows a part longitudinal section through a third exemplary embodiment of a two-stage pressure atomizer nozzle according to the invention with a full jet stage and swirl stage. The design of the nozzle differs from the above described first exemplary embodiment only in that, here too, the nozzle outlet bore 33 does not have a constant diameter. In this third exemplary embodiment, the nozzle outlet bore has an inflow radius $R_e$ which should be about as large as the radius $R_k$ of the chamber 39. Here too, fewer frictional losses occur.

The nozzle according to the invention may be installed, for example, in a swirl-stabilized gas turbine burner or boiler burner, for example a burner of the double cone type, and be adapted to the requirements of the respective burner flow field or to operating states of the gas turbine combustion chamber or of the boiler, even during operation, if necessary. During ignition and in the part load mode, for example, the nozzle is operated via the pressure swirl stage, in that the liquid 37, in this case fuel, passes via the feed duct 36 and the swirl duct 38 (or via a swirl generator arranged in the duct 36) under high pressure, and swirled, into the chamber 39 and is injected via the nozzle outlet bore 33 into the combustion space as finely atomized drops. Due to the rotating movement, a hollow-conical flow is generated at the nozzle bore 33. With an increasing overall fuel quantity and therefore with an increasing risk that drops will be thrown out, there is then a changeover to the full jet nozzle, in that the fuel is introduced, unswirled, via the duct 42 and the feed bore 41 which lies on one axis with the nozzle outlet bore 33, into the chamber 39, from where the fuel then enters the combustion space as a full jet via the nozzle outlet bore 33. The spray angle of the full jet nozzle is extremely low, being around<5°.

Both stages may be operated simultaneously, in which case mixing of the two fuel streams takes place in the chamber 39.

Depending on operating conditions of the gas turbine, the nozzle may also be operated in only one stage. Since extremely small spray angles should, if possible, be set under full load and overload, in that case, for example, only the full jet stage is used and the fuel mass stream flowing through the swirl ducts 38 is cut off completely. Moreover, it is possible, depending on the load range, to feed different liquids, for example water and oil, to the chambers 39 via the ducts 36, 38 and 42, 41 and atomize them after they have been mixed.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A pressure atomizer nozzle, comprising a nozzle body, in which a mixing chamber is designed, said mixing chamber being connected to an outside space via a nozzle outlet bore and having a first feed duct with a feed bore for a liquid to be atomized, through which feed bore said liquid can be supplied, free of swirling and under pressure, at least one further feed duct for a portion of the liquid to be atomized or for a second liquid to be atomized opening into the chamber, through which feed duct said portion of liquid or the second liquid can be fed under pressure, and with swirling, the feed bore of the first feed duct lying on one axis with the nozzle outlet bore, wherein a) the outlet-side diameter of the nozzle outlet bore is at most as large as the diameter of the feed bore, and b) the length of the nozzle outlet bore is at least twice to at most ten times the outlet-side diameter of the nozzle outlet bore.

2. The pressure atomizer nozzle as claimed in claim 1, wherein the outlet-side diameter of the nozzle outlet bore is approximately 0.7 times the diameter of the feed bore.

3. The pressure atomizer nozzle as claimed in claim 1, wherein the nozzle outlet bore is arranged in a cover of a first tube, in which is inserted a second tube of smaller outside diameter, which reaches as far as said cover, and in the cover-side end of the second tube at least one slit is provided, which is set tangentially and forms a swirl duct and which connects the annular space between the first and the second tube to the chamber, from which the nozzle outlet bore leads into the outside space, the chamber being delimited essentially by the cover, the inner walls of the second tube and a filling piece in the second tube, and the feed bore in the filling piece being arranged on the same axis as the nozzle outlet bore.

4. The pressure atomizer nozzle as claimed in claim 1, wherein the nozzle outlet bore has a constant cross-sectional area over its entire length.

5. The pressure atomizer nozzle as claimed in claim 1, wherein the nozzle outlet bore has, over its entire length, a cross-sectional area decreasing continuously in the direction of flow.

6. The pressure atomizer nozzle as claimed in claim 1, wherein the nozzle outlet bore has, at its inflow-side end, an inflow radius which is at least as large as the radius of the chamber.

7. A method for operating a pressure atomizer nozzle as claimed in claim 1 in a swirl-stabilized burner, during ignition and in a part load mode the nozzle being operated via a pressure swirl stage, in that said portion of the liquid to be atomized or a portion of the second liquid to be atomized is fed, swirled, via the feed duct to the chamber, and a sharply swirled flow is generated there, which subsequently passes through the nozzle outlet bore into the outside space, the proportion of liquid, fed via the swirl stage, being reduced with an increasing overall liquid mass flow, wherein, in a full load and overload mode, the nozzle is operated via a full jet stage, in that the liquid is fed via the feed bore to the chamber and passes from there through the nozzle outlet bore into the outside space as a full jet.

8. The method as claimed in claim 7, wherein a sliding changeover is made between the two stages.

9. The method as claimed in claim 7, wherein both stages are operated simultaneously and with a variable throughput.

10. The method as claim 7, wherein only one of the two stages is operated.

* * * * *